US005991946A

United States Patent [19]

Harris

[11] Patent Number: 5,991,946

[45] Date of Patent: Nov. 30, 1999

[54] CRIB SHEET

[76] Inventor: Beth Harris, 1329 Chippewa Dr., Ottawa, Ill. 61350

[21] Appl. No.: 09/262,242

[22] Filed: Mar. 4, 1999

[51] Int. Cl.[6] ..... A47G 9/02

[52] U.S. Cl. ..... 5/497; 5/485

[58] Field of Search ..... 5/485, 490, 497, 5/482, 455; D6/595, 596, 602

[56] References Cited

U.S. PATENT DOCUMENTS

| | | | |
|---|---|---|---|
| 1,343,881 | 6/1920 | Christensen | 5/485 |
| 3,148,388 | 9/1964 | Espersen | 5/497 |
| 4,014,055 | 3/1977 | Torres | 5/485 |
| 4,607,402 | 8/1986 | Pollard | 5/485 |
| 4,937,904 | 7/1990 | Ross | 5/497 |
| 5,008,966 | 4/1991 | Lepow | 5/497 |

*Primary Examiner*—Alexander Grosz

[57] ABSTRACT

A new crib sheet for allowing for safe use of a pillow in a baby crib. The inventive device includes a sheet having a generally rectangular configuration. The sheet has a periphery defined by long opposed side edges and short opposed end edges. The periphery has a peripheral elastic band extending therearound to facilitate securement of the sheet to a mattress. A pillow pouch is formed within an upper portion of the sheet. The pillow pouch receives a pillow therein for securement within the sheet.

6 Claims, 2 Drawing Sheets

CRIB SHEET

BACKGROUND OF THE INVENTION

1. Field of the Invention

The present invention relates to baby accessories and more particularly pertains to a new crib sheet for allowing for safe use of a pillow in a baby crib.

2. Description of the Prior Art

The use of baby accessories is known in the prior art. More specifically, baby accessories heretofore devised and utilized are known to consist basically of familiar, expected and obvious structural configurations, notwithstanding the myriad of designs encompassed by the crowded prior art which have been developed for the fulfillment of countless objectives and requirements.

Known prior art baby accessories include U.S. Pat. No. 4,924,543 to Hoss et al.; U.S. Pat. No. 4,383,713 to Roston; U.S. Pat. No. 4,873,734 to Pollard; U.S. Pat. No. 4,707,753 to Lunt; U.S. Pat. No. 5,010,611 to Mallett; and U.S. Pat. No. Des. 317,841 to Mendyk.

While these devices fulfill their respective, particular objectives and requirements, the aforementioned patents do not disclose a new crib sheet. The inventive device includes a sheet having a generally rectangular configuration. The sheet has a periphery defined by long opposed side edges and short opposed end edges. The periphery has a peripheral elastic band extending therearound to facilitate securement of the sheet to a mattress. A pillow pouch is formed within an upper portion of the sheet. The pillow pouch receives a pillow therein for securement within the sheet.

In these respects, the crib sheet according to the present invention substantially departs from the conventional concepts and designs of the prior art, and in so doing provides an apparatus primarily developed for the purpose of allowing for safe use of a pillow in a baby crib.

SUMMARY OF THE INVENTION

In view of the foregoing disadvantages inherent in the known types of baby accessories now present in the prior art, the present invention provides a new crib sheet construction wherein the same can be utilized for allowing for safe use of a pillow in a baby crib.

The general purpose of the present invention, which will be described subsequently in greater detail, is to provide a new crib sheet apparatus and method which has many of the advantages of the baby accessories mentioned heretofore and many novel features that result in a new crib sheet which is not anticipated, rendered obvious, suggested, or even implied by any of the prior art baby accessories, either alone or in any combination thereof.

To attain this, the present invention generally comprises a sheet having a generally rectangular configuration. The sheet has a periphery defined by long opposed side edges and short opposed end edges. The opposed side edges extends outwardly at an upper portion of the sheet whereby an upper end edge is longer than a lower end edge. The periphery has a peripheral elastic band extending therearound to facilitate securement of the sheet to a mattress. The opposed side edges have a pair of supplemental elastic bands extending therebetween to facilitate further securement of the sheet to a mattress. The periphery has ruffled flaps extending downwardly therefrom. A pillow pouch is formed within the upper portion of the sheet. The pillow pouch has a slot formed by overlapping flaps in a central portion thereof. The slot receives a pillow therein for securement within the pillow pouch. A side pillow pouch is formed within the sheet inwardly of one of the opposed side edges thereof. The side pillow pouch is dimensioned for receiving an infant side sleeper pillow therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new crib sheet apparatus and method which has many of the advantages of the baby accessories mentioned heretofore and many novel features that result in a new crib sheet which is not anticipated, rendered obvious, suggested, or even implied by any of the prior art baby accessories, either alone or in any combination thereof.

It is another object of the present invention to provide a new crib sheet which may be easily and efficiently manufactured and marketed.

It is a further object of the present invention to provide a new crib sheet which is of a durable and reliable construction.

An even further object of the present invention is to provide a new crib sheet which is susceptible of a low cost of manufacture with regard to both materials and labor, and which accordingly is then susceptible of low prices of sale to the consuming public, thereby making such crib sheet economically available to the buying public.

Still yet another object of the present invention is to provide a new crib sheet which provides in the apparatuses and methods of the prior art some of the advantages thereof, while simultaneously overcoming some of the disadvantages normally associated therewith.

Still another object of the present invention is to provide a new crib sheet for allowing for safe use of a pillow in a baby crib.

Yet another object of the present invention is to provide a new crib sheet which includes a sheet having a generally rectangular configuration. The sheet has a periphery defined by long opposed side edges and short opposed end edges. The periphery has a peripheral elastic band extending therearound to facilitate securement of the sheet to a mattress. A pillow pouch is formed within an upper portion of the sheet. The pillow pouch receives a pillow therein for securement within the sheet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
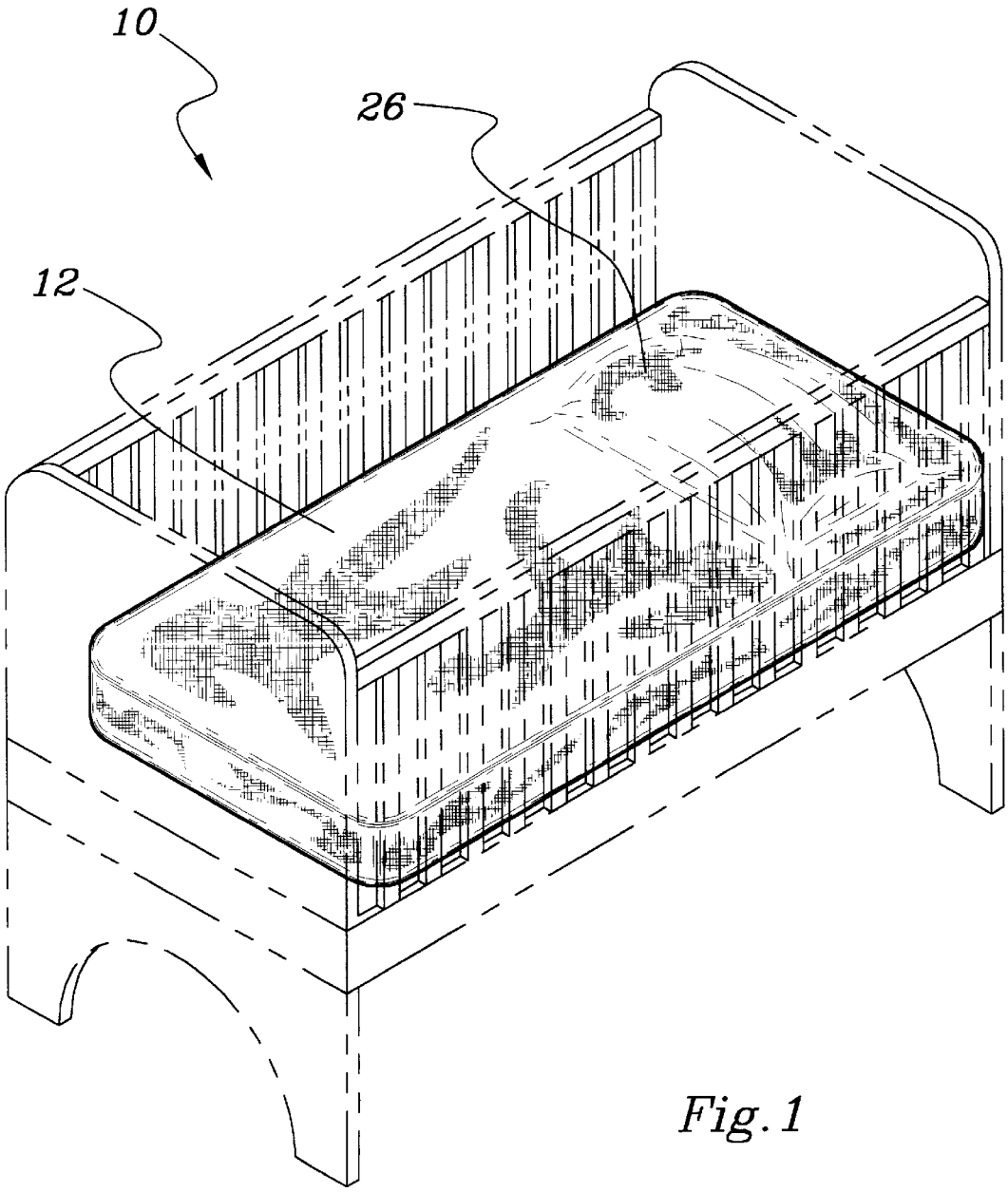
FIG. 1 is a perspective view of a new crib sheet according to the present invention illustrated in use.
Figure 2:
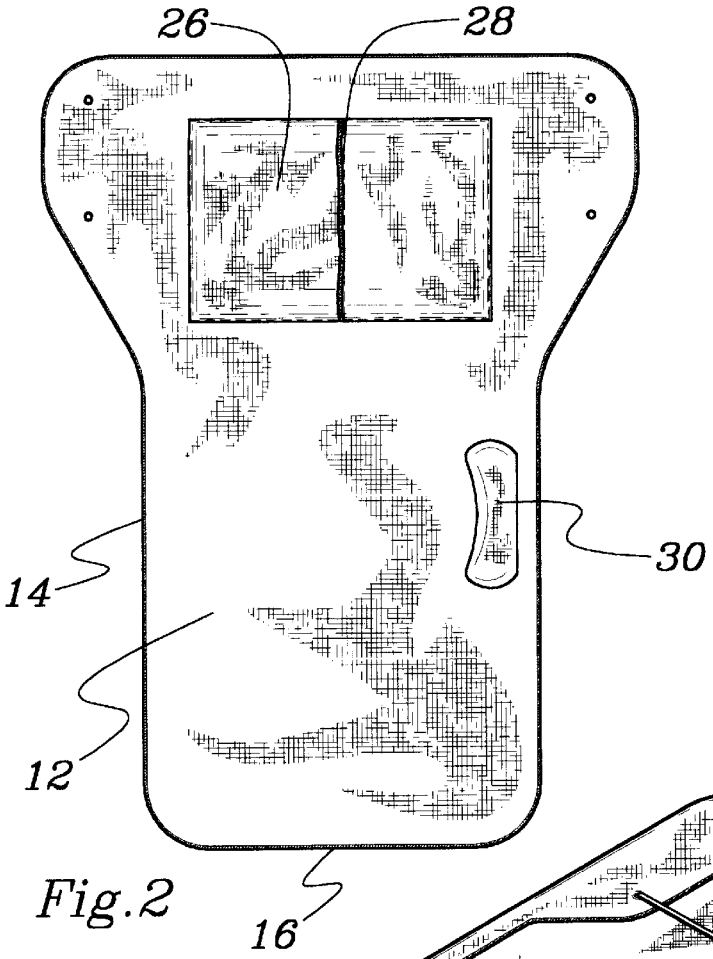
FIG. 2 is a top plan view of the present invention.
Figure 3:
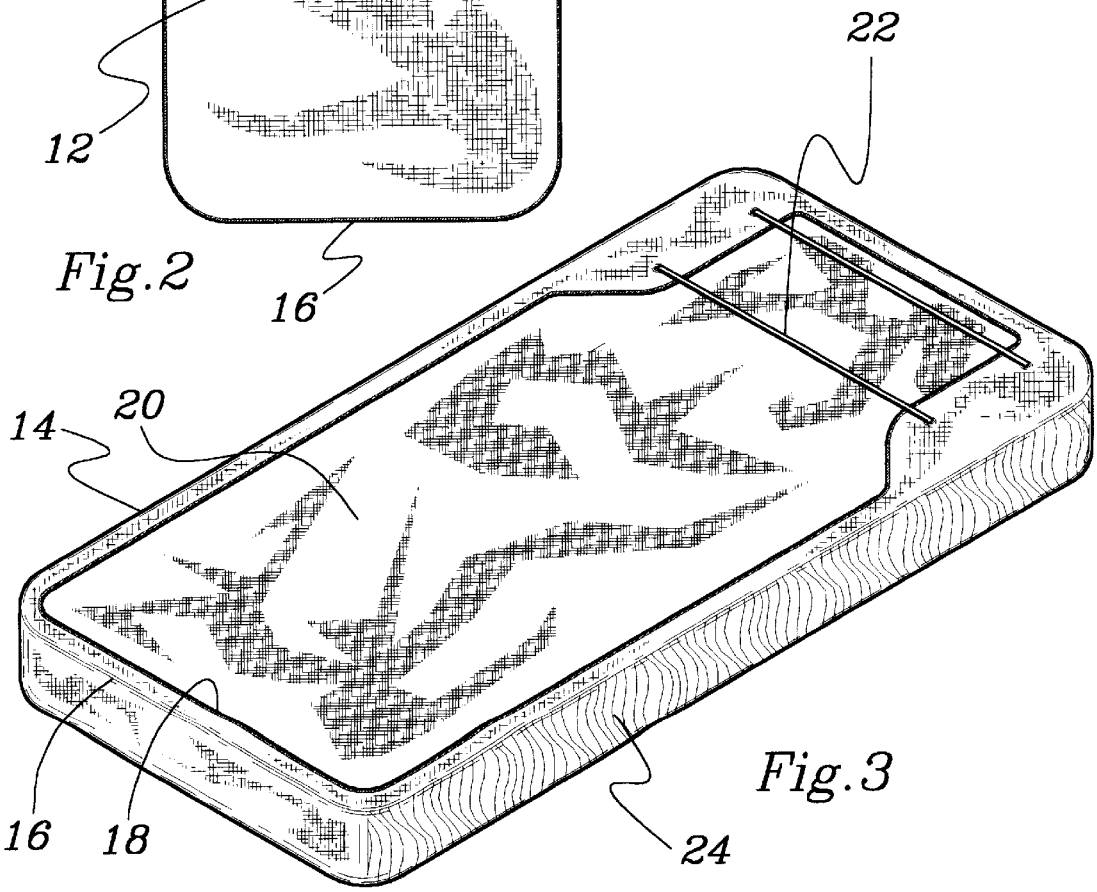
FIG. 3 is a bottom perspective view of the present invention.

With reference now to the drawings, and in particular to FIGS. 1 through 3 thereof, a new crib sheet embodying the principles and concepts of the present invention and generally designated by the reference numeral 10 will be described.

As best illustrated in FIGS. 1 through 3, the crib sheet 10 comprises a sheet 12 having a generally rectangular configuration. The sheet 12 would be similar in construction and size to standard, fitted crib sheets. The sheet 12 could be made of washable cotton or cotton/polyester blend. The sheet 12 has a periphery defined by long opposed side edges 14 and short opposed end edges 16. The opposed side edges 14 extends outwardly at an upper portion of the sheet 12 whereby an upper end edge is longer than a lower end edge. The periphery has a peripheral elastic band 18 extending therearound to facilitate securement of the sheet 12 to a mattress 20. The opposed side edges 14 have a pair of supplemental elastic bands 22 extending therebetween to facilitate further securement of the sheet 12 to a mattress 20. The periphery has ruffled flaps 24 extending downwardly therefrom.

A pillow pouch 26 is formed within the upper portion of the sheet 12. The pillow pouch 26 has a slot 28 formed by overlapping flaps in a central portion thereof. The slot 28 receives a pillow therein for securement within the pillow pouch 26. The wider upper portion of the sheet 12 will allow for the securement of the sheet 12 to the mattress 20 when a pillow is positioned within the pillow pouch 26.

A side pillow pouch 30 is formed within the sheet 12 inwardly of one of the opposed side edges 14 thereof. The side pillow pouch 30 is dimensioned for receiving an infant side sleeper pillow therein. This will support an infant in the recommended side-sleeping position. An additional side pillow pouch could be formed on an opposing side to better facilitate the side-sleeping position.

In use, the present invention will provide a safer means of elevating a baby's upper body and head in the crib. Often, a child will sleep easier and more comfortably with a pillow, and elevating the head and upper body can be especially important when the baby is sick or suffering from any kind of upper respiratory problems. Pillows, however, can pose a suffocation hazard for a baby in a crib. The present invention would allow the pillow to be positioned in such a manner that it would not shift, and the baby could not get caught between the pillow and the bed. In addition, the elastic band 18 and straps 22 would ensure that the child could not pull the sheet 12 loose and wrap themselves up in it.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new crib sheet for allowing for safe use of a pillow in a baby crib comprising, in combination:

a sheet having a generally rectangular configuration, the sheet having a periphery defined by long opposed side edges and short opposed end edges, the opposed side edges extending outwardly at an upper portion of the sheet whereby an upper end edge is longer than a lower end edge, the periphery having a peripheral elastic band extending therearound to facilitate securement of the sheet to a mattress, the opposed side edges having a pair of supplemental elastic bands extending therebetween to facilitate further securement of the sheet to a mattress, the periphery having ruffled flaps extending downwardly therefrom;

a pillow pouch formed within the upper portion of the sheet, the pillow pouch having a slot formed by overlapping flaps in a central portion thereof, the slot receiving a pillow therein for securement within the pillow pouch;

a side pillow pouch formed within the sheet inwardly of one of the opposed side edges thereof, the side pillow pouch being dimensioned for receiving an infant side sleeper pillow therein.

2. A crib sheet for allowing for safe use of a pillow in a baby crib, the crib sheet comprising:

a sheet having a generally rectangular configuration, the sheet having a periphery defined by long opposed side edges and short opposed end edges, the periphery having a peripheral elastic band extending therearound to facilitate securement of the sheet to a mattress;

a pillow pouch formed within an upper portion of the sheet, the pillow pouch receiving a pillow therein for securement within the sheet; and wherein the pillow pouch has a slot formed by overlapping flaps in a central portion thereof.

3. The crib sheet as set forth in claim 2 wherein the opposed side edges of the sheet extend outwardly at an upper portion thereof whereby an upper end edge is longer than a lower end edge.

4. The crib sheet as set forth in claim 2 wherein the opposed side edges of the sheet have a pair of supplemental elastic bands extending therebetween to facilitate further securement of the sheet to a mattress.

5. The crib sheet as set forth in claim 2 wherein the periphery of the sheet has ruffled flaps extending downwardly therefrom.

6. The crib sheet as set forth in claim 2 and further including a side pillow pouch formed within the sheet inwardly of one of the opposed side edges thereof, the side pillow pouch being dimensioned for receiving an infant side sleeper pillow therein.

* * * * *